US009273510B2

(12) United States Patent
Pardoe

(10) Patent No.: US 9,273,510 B2
(45) Date of Patent: Mar. 1, 2016

(54) SYSTEMS, DEVICES, AND/OR METHODS FOR MANAGING DOOR FRAMES

(71) Applicant: Keith Pardoe, Bealeton, VA (US)

(72) Inventor: Keith Pardoe, Bealeton, VA (US)

( * ) Notice: Subject to any disclaimer, the term of this patent is extended or adjusted under 35 U.S.C. 154(b) by 0 days.

(21) Appl. No.: 14/254,821

(22) Filed: Apr. 16, 2014

(65) Prior Publication Data

US 2014/0310912 A1 Oct. 23, 2014

Related U.S. Application Data

(60) Provisional application No. 61/813,325, filed on Apr. 18, 2013.

(51) Int. Cl.

| | |
|---|---|
| ***E06B 1/04*** | (2006.01) |
| ***E06B 1/34*** | (2006.01) |
| *E06B 5/16* | (2006.01) |
| *E06B 1/22* | (2006.01) |

(52) U.S. Cl.

CPC . *E06B 1/347* (2013.01); *E06B 1/22* (2013.01); *E06B 5/16* (2013.01); *Y10T 16/61* (2015.01)

(58) Field of Classification Search

CPC ..... E06B 1/347; E06B 1/045; E06B 5/113; E06B 5/16; E06B 5/122; Y10T 16/61; Y10T 16/551

See application file for complete search history.

(56) References Cited

U.S. PATENT DOCUMENTS

| | | | | |
|---|---|---|---|---|
| 1,555,221 | A * | 9/1925 | Long | 49/482.1 |
| 1,620,933 | A | 3/1927 | Wilcox | |
| 1,926,673 | A * | 9/1933 | Gregg | 52/211 |
| 2,834,066 | A * | 5/1958 | Lybarger | 49/505 |
| 3,364,624 | A * | 1/1968 | Davis | E06B 1/20 49/505 |
| 3,608,254 | A | 9/1971 | Sklamberg | |
| 3,685,226 | A * | 8/1972 | Richter | 52/217 |
| 3,690,037 | A | 9/1972 | Kempel | |
| 3,707,815 | A | 1/1973 | Molyneux | |
| 3,906,671 | A | 9/1975 | Maldonado | |
| 4,126,975 | A * | 11/1978 | Williams | E06B 1/18 49/505 |
| 4,128,977 | A | 12/1978 | Schubeis | |
| 4,299,068 | A | 11/1981 | Nielsen | |
| 4,344,265 | A | 8/1982 | Davidson | |
| 4,429,495 | A | 2/1984 | Aoki | |
| 4,453,346 | A * | 6/1984 | Powell et al. | 49/404 |
| 4,601,144 | A | 7/1986 | Tinti | |
| 4,635,400 | A | 1/1987 | Mullet | |
| 4,674,248 | A * | 6/1987 | Hall | 52/212 |
| 4,768,320 | A | 9/1988 | Weller | |
| 4,791,758 | A | 12/1988 | Bauer | |
| 4,793,109 | A * | 12/1988 | Noach | E06B 1/347 403/408.1 |
| 4,878,325 | A * | 11/1989 | Van Tuyl et al. | 52/217 |
| 5,070,651 | A * | 12/1991 | Jeter | 49/505 |
| 5,203,130 | A | 4/1993 | Freelove | |

(Continued)

FOREIGN PATENT DOCUMENTS

WO WO 9814681 A1 * 4/1998

*Primary Examiner* — Patrick Maestri

(74) *Attorney, Agent, or Firm* — Stanzione & Associates, PLLC

(57) ABSTRACT

Exemplary embodiments as described herein can provide a door stop extension system adapted for installation in a pre-existing door frame. The door stop extension systems according to exemplary embodiments described herein can be adapted to increase a height of a pre-existing door stop by a predetermined amount. The door stop extension systems according to exemplary embodiments described herein can be adapted to cause a correction of a non-compliance of a pre-existing door system with National Fire Protection Association's publication 80 specifications.

11 Claims, 18 Drawing Sheets

(56) References Cited

U.S. PATENT DOCUMENTS

| | | | |
|---|---|---|---|
| 5,333,424 | A | 8/1994 | Chalfant |
| 5,435,104 | A | 7/1995 | Dietrich |
| 5,669,192 | A | 9/1997 | Opdyke |
| 5,778,601 | A | 7/1998 | Wu |
| 5,927,039 | A | 7/1999 | DeBoer |
| 5,941,033 | A | 8/1999 | Adams |
| 6,088,966 | A | 7/2000 | Kenkel |
| 6,233,879 | B1 | 5/2001 | Barbeau |
| 6,550,828 | B2 | 4/2003 | Warden |
| 6,807,777 | B2 | 10/2004 | Wagner |
| 6,826,877 | B1 | 12/2004 | Stradel |
| 6,948,287 | B2 | 9/2005 | Korn |
| 7,165,364 | B2 | 1/2007 | Inelli |
| 7,743,560 | B2 | 6/2010 | Box |
| 7,913,465 | B2 | 3/2011 | Yeremian |
| 7,950,199 | B2 | 5/2011 | Newhouse |
| 8,069,625 | B2 | 12/2011 | Harkins |
| 8,146,295 | B2 | 4/2012 | Kibbel |
| 8,261,498 | B2 | 9/2012 | Poirier |
| 8,276,320 | B2 | 10/2012 | Erbrect |
| 2003/0189341 | A1* | 10/2003 | Perry ..... E05B 17/2003 292/346 |
| 2004/0221527 | A1 | 11/2004 | Sykora |
| 2005/0268559 | A1 | 12/2005 | Ellingson |
| 2007/0011961 | A1 | 1/2007 | Annes |
| 2007/0204553 | A1 | 9/2007 | Bunker |
| 2008/0277949 | A1 | 11/2008 | Emde |
| 2009/0049755 | A1 | 2/2009 | Rohrer, Sr. |
| 2010/0162630 | A1 | 7/2010 | Shim |
| 2011/0067205 | A1 | 3/2011 | Wing |
| 2012/0023825 | A1 | 2/2012 | Labrecque |
| 2012/0042590 | A1 | 2/2012 | Yosef |
| 2012/0204403 | A1 | 8/2012 | Spencer |
| 2012/0285102 | A1 | 11/2012 | Park |
| 2012/0311944 | A1 | 12/2012 | Stier |
| 2014/0260017 | A1 | 9/2014 | Noble, III |

* cited by examiner

CONVENTIONAL

2000
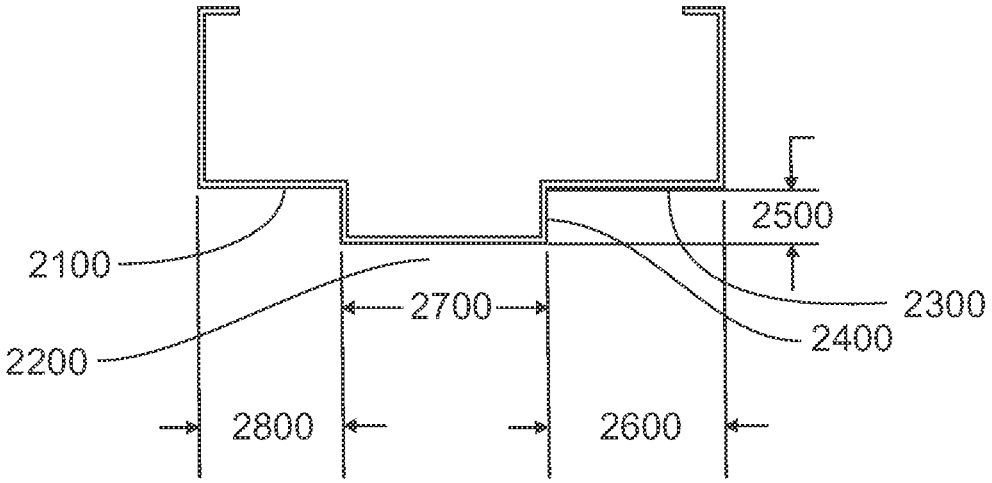
Fig. 2
CONVENTIONAL

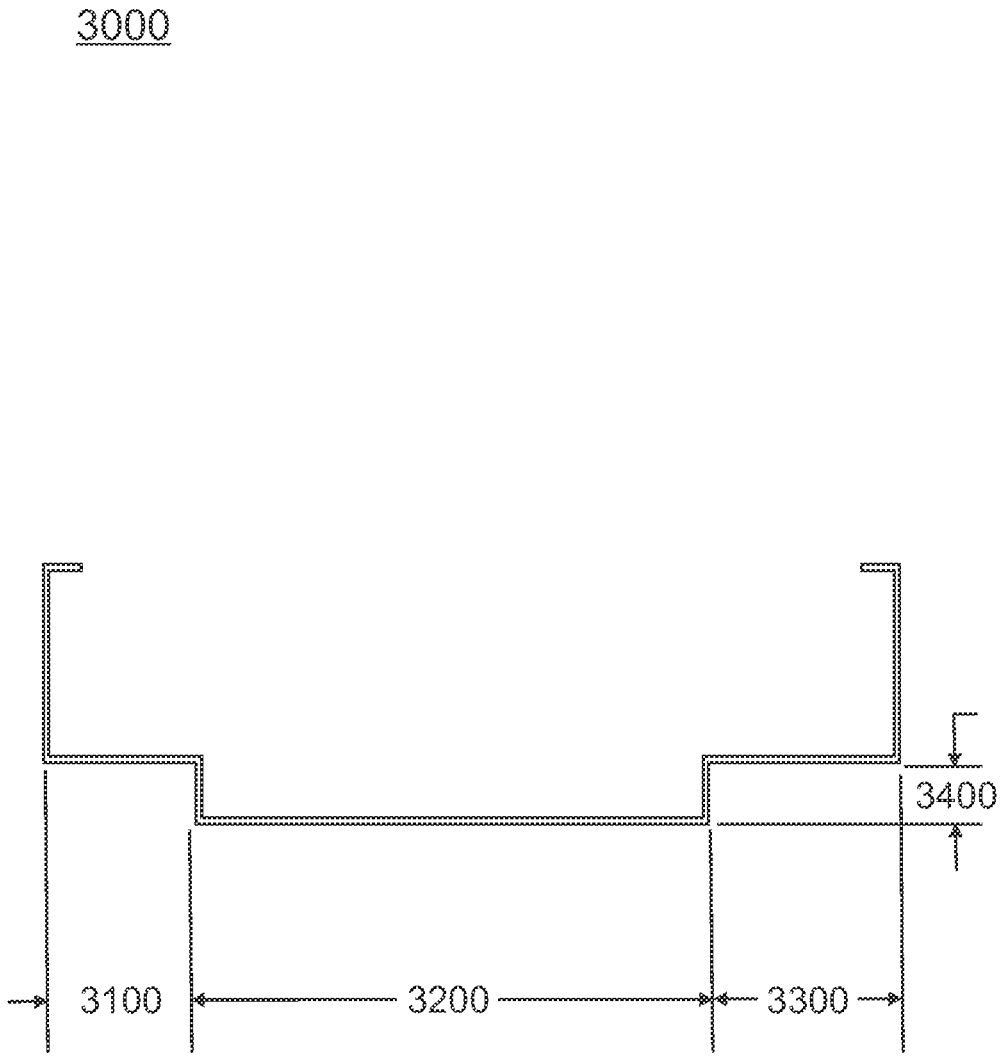
Fig. 3
CONVENTIONAL

SYSTEMS, DEVICES, AND/OR METHODS FOR MANAGING DOOR FRAMES

CROSS-REFERENCES TO RELATED APPLICATIONS

This application claims priority to, and incorporates by reference herein in its entirety, U.S. Provisional Patent Application Ser. No. 61/813,325, filed 18 Apr. 2013.

BRIEF DESCRIPTION OF THE DRAWINGS

A wide variety of potential practical and useful embodiments will be more readily understood through the following detailed description of certain exemplary embodiments, with reference to the accompanying exemplary drawings in which:

FIG. 2 illustrates a cross-section 2000 cut of the conventional door frame as shown on FIG. 1;

FIG. 3 illustrates a cross-section 3000 cut of the conventional door frame as shown on FIG. 1;

DETAILED DESCRIPTION

Figure 1:
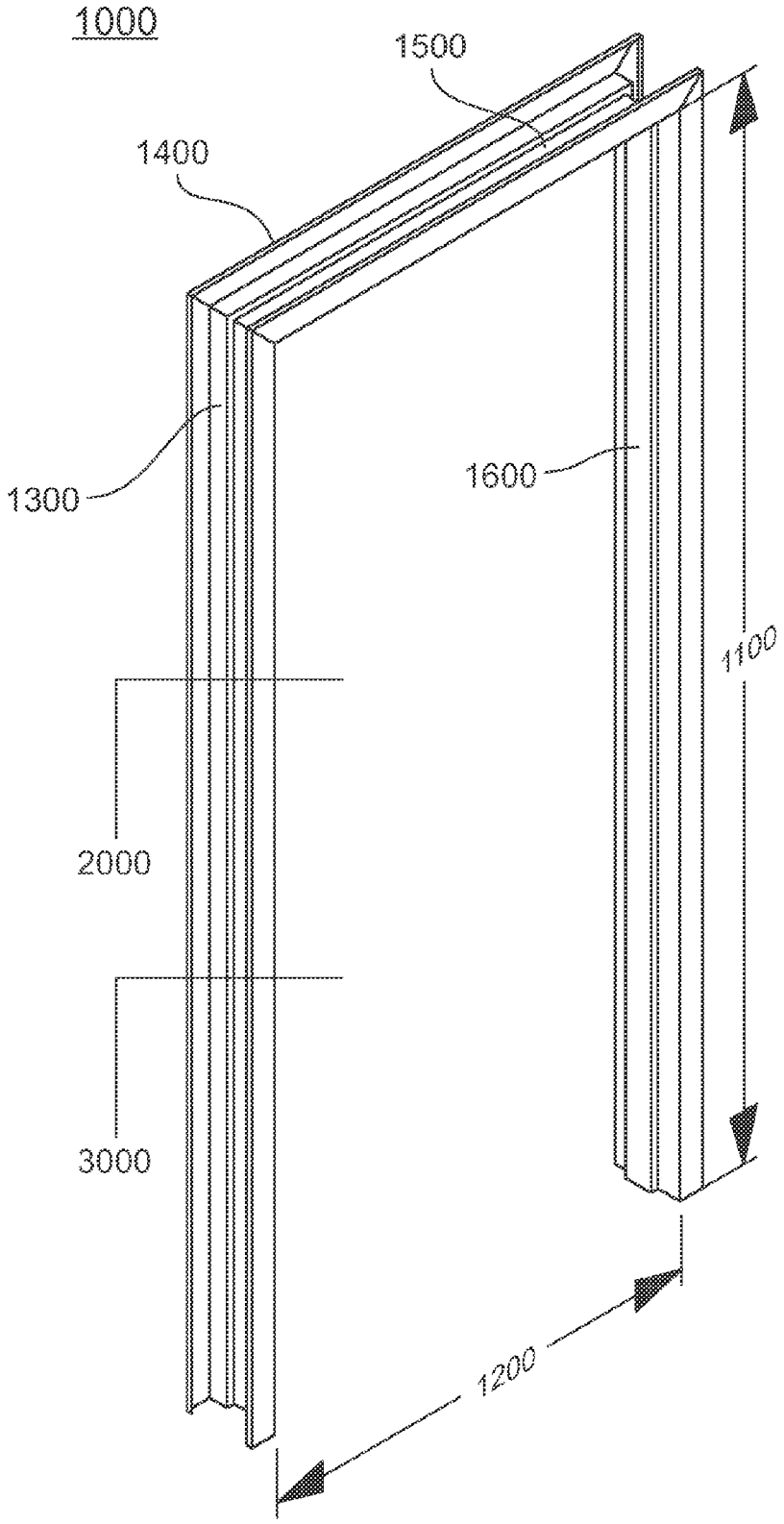
FIG. 1 illustrates a conventional door frame 1000.

Certain exemplary embodiments can provide a door stop extension adapted for installation in a conventional door frame. The door stop extension is adapted to increase a height of a door stop by a predetermined amount. The door stop extension can provide a correction of a non-compliance of a door system in accordance with National Fire Protection Association's publication 80 specifications.

Certain exemplary embodiments provide a system designed to extend the height of door stops and provide desired clearances between the vertical and horizontal edges of doors installed in fire-rated hollow metal door frames to within building and fire code requirements. Certain exemplary embodiments can be labeled, listed, and installed for field application on swinging fire door assemblies, such as an aftermarket component.

Swinging fire door assemblies with builders' hardware are installed in almost every non-residential building. These types of fire door assemblies can be required to be installed in accordance with National Fire Protection Association ("NFPA") 80, Standard for Fire Doors and Other Opening Protectives, (current edition is 2013) as published by the NFPA and as referenced by certain model building, fire, and life safety codes. Swinging fire door assemblies with builders' hardware can be designed to provide fire protection for approximately ⅓ hour, ½ hour, ¾ hour, 1 hour, 1½ hours, and/or 3 hours, etc. Chapter 6 of NFPA 80 requires swinging fire doors with builders' hardware to provide three main functions: 1) swing freely, 2) be self-closing or arranged for automatic-closing, and 3) positively latch in the closed position. Among the many requirements in NFPA 80 is a requirement that the swinging fire doors be installed within a specified range of clearance dimensions between the vertical and horizontal edges of the doors, when the doors are in the closed position, and the rabbets of the frames.

The integral door stop of hollow metal door frames is a critical element that supports the door leaves, when they are in the closed position, under fire conditions; especially, when the doors are subjected to the intense pressure exerted on them by water streaming from fire hoses. The industry-standard stop height for fire-rated hollow metal door frames is ⅝-inch. When the door leaves and door frames are properly installed within acceptable tolerances, the door stops are able to perform their intended function.

Unlike other types of fire door assemblies that are manufactured and installed as complete units, swinging fire doors with builders hardware are component-based door assemblies that are comprised of a fire rated door frame, a fire rated door (or doors, in the case of paired openings), and fire rated builders hardware items (e.g., hinges, locks, door closers, strike plates, and/or protection plates, etc.); each component can sometimes be the product of a different manufacturer. Installer personnel can assemble these components at a construction site to create the completed door assembly. It is common practice for door frames installed in masonry walls to be erected by a masonry contractor early in the construction process and door frames in wood and metal stud partitions and walls to be installed by the rough carpenters or drywall installers. The door leaves and builders hardware are often installed by yet other installer personnel very late in the construction process; this practice contributes to potential problems of swinging fire doors with builders' hardware having excessive clearance dimensions. When the door frames are not correctly set within installation tolerances for level, plumb, square, and true, the clearance dimensions between the vertical and horizontal edges of the door leaves, in the closed position, can exceed the specified clearance dimensions mandated in industry standards such as NFPA 80.

When the clearance dimensions between the vertical edges and horizontal edges of the door assembly exceed NFPA 80's clearance requirements, the surface area of the door stop that supports the door leaves is proportionally reduced. The reduced surface area of the stop that supports the door leaves could fail to perform its intended function, thereby causing the fire door assembly to fail under fire conditions.

In 2007, NFPA 80 mandated formal annual safety inspections of existing and new fire door assemblies, including swinging fire doors with builders' hardware. Consequently, NFPA 80's safety inspections are causing building owners to remove and reinstall fire door assemblies that are discovered to have excessive clearance dimensions between the vertical and horizontal edges of the doors and the rabbets of the frame in order to make the door assemblies compliant to NFPA 80's requirements.

Existing fire door assemblies can have excessive clearance gaps between the edges of the doors and the frames. The door stops of the frames are critically important when the doors are exposed to fire conditions. Excessive clearance gaps reduce the effectiveness of the door stops that are integral to the frames. The greater the clearance between the door and the frame, the less the door stops are able to maintain the fire-rating of the door assembly.

Currently, short of removing and reinstalling the swinging fire door assemblies, building owners have very few options to restore their fire door assemblies to meet NFPA 80's requirements. Removal and reinstallation of the fire rated frames disturbs the finished walls and floors and disrupts normal building operation and usage; it is a time-consuming and expensive process that can yield marginal results.

Certain exemplary embodiments described herein can be subjected to rigorous fire testing by one of the nationally recognized testing laboratories and can be labeled and listed for field application on swinging fire door assemblies. Certain exemplary embodiments can be installed on swinging fire rated door assemblies, thereby providing an economical solution to non-complaint fire doors in a timely manner; eliminating the site visits by one or more testing laboratories.

Certain exemplary embodiments described herein can be designed to fit over integral door stops in fire rated hollow metal door frames and partially cover and/or wrap the profile of the door frames; thereby extending the surface area door stops by increasing height of the door stops by a predetermined amount such as approximately ¼-inch. Door stop extensions can be manufactured from the same materials as the door frames and can be aesthetically pleasing; blending with the existing door frames.

Certain exemplary embodiments described herein can match existing fire rated door frames and not be highly noticeable after installation. Certain exemplary embodiments described herein can save building owners a great deal of time by eliminating the waiting period for the testing labs to schedule field inspections of affected fire door assemblies.

Certain exemplary embodiments provide:

- A door stop extension outer shell, which formed from metal such as a sixteen gage cold rolled steel or stainless steel. The outer shell can be formed by bending/breaking the angles needed to create the shape of the door stop extensions to fit over the profile shapes of conventional door frames as illustrated in FIG. 2 and FIG. 3. The outer shell can be formed to fit other hollow metal frame profile shapes. The face of the outer shell can be drilled and countersunk for steel or stainless steel screws.
- Reinforcement plates, which can be made of metal such as eleven gage steel, can be tack welded into the back of the outer shell, such as at six inches on center. Alternatively, a continuous reinforcement plate, which can also be made from metal such as an eleven gage steel, that extends substantially the full length of each piece can be substituted for individual plates.
- A spacer can be used to support the door stop extensions when it is installed on narrow door profile door frames.
- The face of the outer shell of the conventional door frame (see, e.g., face 15400 of FIG. 15) is exposed to view after installation.
- Reinforcement plates can be added to strengthen the shell and prevent it from deforming when the screws are tightened securely to the door frame. The reinforcement plates can also act as spacers when fastening screws are tightened. The alternative full length reinforcement plate is used to provide support for mounting soffit applied hardware to the door assembly.
- In certain exemplary embodiments, a correct number of screws (and size of screws) can be used to install the door stop extensions. All screw holes can be required to be used to maintain the fire rating of the door stop extension and the door assembly.
- An auxiliary component metal spacer can be used to install the door stop extensions on door frames that are less than 5½ inches in depth.

Certain exemplary embodiments of the door stop extensions described herein are surface applied to existing door frames by field cutting them to length and screwing them to the door frame. All pieces of the set can be used to fully restore the fire door assembly to compliance with the building and fire codes.

The outer shell of the door stop extensions can be manufactured by break forming or cold-rolled forming methods of metal working. The reinforcement plates can be formed from sheet metal (e.g., eleven gage sheet metal) that are cut to size and tack welded into the back of the outer shell. The fastener holes can be formed by drilling, reaming, or by a punch and dimple process.

Certain exemplary embodiments can utilize an auxiliary spacer, which can be formed from sheet metal (e.g., fourteen gage sheet metal) and inserted into the back of the shell at the time of installation.

A fire door assembly can be reviewed to determine whether it subject to the required annual inspection and/or is in compliance with NFPA 80's requirements. If the door assembly fails the inspection due to excessive clearance between the doors and the frames, a set of door stop extensions can be obtained and installed on the door assembly. Installation can be accomplished by cutting the pieces to length and screwing them to the door frame. Once installed, the door stop extensions become an integral part of the frame and the fire door assembly and can last the lifetime of the assembly.

FIG. 1 is a perspective view of a conventional door frame 1000, in which a door stop extension according to exemplary embodiments of the inventive concept can be adapted to be installed to correct a non-compliance of the door frame with an established standard. The door stop extension system according to the exemplary embodiments herein can have a height to correspond with the height 1100 of the conventional door frame 1000, or can have a height appropriate to fit any existing door frame. For example, in certain exemplary embodiments height 1100 can be, in inches, approximately 70, 71.7, 74.33, 76, 79.9, 80.74, 84, 88.51, 89.9390, 92, 95.125, 97, 99.08, 103.25, 108, 111.93, 114.56, 117.73, or 120, or any value therebetween. Those skilled in the art will recognize that conventional door frames are available in other height dimensions. Accordingly, certain exemplary embodiments of the door stop extension as described herein can have a height to fit any existing conventional door frame. The door stop extension according to exemplary embodiments described herein can have a width appropriate to fit a width 1200 of the conventional door frame 1000. Those skilled in the art will recognize that conventional door frames are available in other width dimensions. Accordingly, certain exemplary embodiments of the door stop extensions described herein can have a width to fit any existing conventional door frame.

The door stop extension system according to exemplary embodiments described herein can be adapted to increase a door stop height by a predetermined amount. The stop extension system according to exemplary embodiments described herein can be adapted to correct a non-compliance with an industry standard for a fire rating. The door stop extension system according to exemplary embodiments described herein can be adapted for installation in a door frame. The door stop extension system according to exemplary embodiments described herein can be adapted to cause a correction of a non-compliance with National Fire Protection Association's publication 80 specifications.

An outer shell 1400 of a conventional door frame 1000 can be formed from sixteen gage cold rolled steel or stainless steel. Outer shell 1400 of the conventional door frame 1000 can be formed by bending/breaking angles to create a shape of the frame 1000. Steel reinforcement plates are tack welded into a back of an outer shell of the conventional door frame 1000. A continuous reinforcement plate 1500 that extends substantially a full length of a back of an outer shell of the conventional door frame 1000 can be installed. Face 1600 of an outer shell of the conventional door frame 1000 can be drilled and countersunk for steel or stainless steel screws. Door stop extension systems according to exemplary embodiments described herein can be field cut to fit such conventional door frames 1000.

FIG. 2 is a cross-section 2000 cut of the conventional door frame 1000 as shown in FIG. 1, which can comprise a rabbet 2100, a door stop (or soffit) 2200, a door stop length 2400, and a door rabbet 2300. Cross-section 2000 can be adapted for use with a double rabbet (unequal rabbet) fire rated metal door frame. Other frame profiles can be used also. The dimensions of cross-section 2000 are overall width 2900, a rabbet width 2800, a door stop width 2700, a door rabbet width 2600, and a door stop height 2500 (also referred to as the door stop cap).

Figure 4:
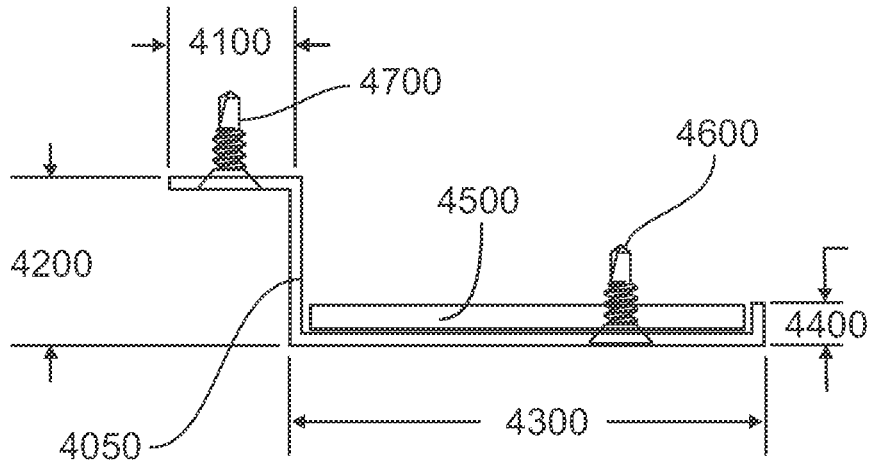
FIG. 4 illustrates a cross-section view of a door stop extension 4000 according to an exemplary embodiment.

FIG. 3 is a cross-section 3000 cut of the conventional door frame 1000 as shown in FIG. 1. Cross-section 3000 illustrates an example of a double rabbet (unequal rabbet) fire rated metal door frame. Other frame profiles can be used. The dimensions of cross-section 3000 of the conventional frame 1000 comprise a rabbet width 3100, a door stop (or soffit) width 3200, a door rabbet width 3300, and a door stop height 3400. FIG. 4 illustrates a cross-section of a door stop extension system 4000 according to an exemplary embodiment of the present inventive concept. A door stop extension 4050 of the system 4000 can be made from steel or stainless steel that is an appropriate thickness, such as sixteen gage cold rolled steel or stainless steel. System 4000 can also comprise a spacer 4500, which can be made from a material of a suitable thickness, such as from eleven gage steel in certain exemplary embodiments. Spacer 4500 can be adapted to allow use of the door stop extension system 4000 with a wider range of door frames than would be possible with system 4000 without spacer 4500. When operatively installed, spacer 4500 can be substantially in contact with a pre-existing door stop frame 2000 (see FIG. 2) to increase a height of a door stop 2400 (see FIG. 2). Door stop extension system 4000 can be coupled to the pre-existing door frame 1000 or 2000 via fasteners such as a first fastener 4600 and a second fastener 4700. Spacer 4500 can be adapted to be installed between door stop extension 4050 and a door frame 1000, 2000 or 3000 when door stop extension 4050 is installed on narrow door profile door frames. Door stop extension 4050 can be installed via the fastener a 4600 coupled to a door stop (i.e., door stop 2200 of FIG. 2). Door stop extension 4050 can be installed via a fastener 4700 coupled to a rabbet (i.e., rabbet 2100 of FIG. 2) of the door frame.

The dimensions of the cross-section of the door stop extension system 4000 may comprise a rabbet width portion 4100, a door stop (or soffit) width portion 4300, a soffit flange width portion 4400, and a door stop height portion 4200. The rabbet width portion 4100 can be any value appropriate to fit the existing door frame. For example, in certain exemplary embodiments rabbet width portion 4100 can be, in inches, approximately 0.375, 0.419, 0.625, 0.75, 0.8, 0.819, 0.975, 1.133, 1.45, 1.5625, 1.625, 1.75, 1.875, 2.1, 2.357, 2.5, or any value therebetween. Door stop width portion 4300 can be any value appropriate to fit the existing door frame. For example, in certain exemplary embodiments the door stop width portion 4300 can be, in inches, approximately 0.7, 0.89, 0.913, 0.975, 1.289, 1.54, 1.519, 1.625, 1.75, 1.875, 2.25, 2.357, 2.5, 2.618, 2.819, 3, 3.419, 4.138, 4.793, 5, 5.25, 6, or any value therebetween. Soffit flange width portion 4400 can be any value appropriate to fit the existing door frame. For example, in certain exemplary embodiments the soffit flange width portion 4400 can be, in inches, approximately 0.1, 0.119, 0.124, 0.141, 0.167, 0.1775, 0.2, 0.219, 0.25, 0.299, 0.348, 0.5, 0.625, 0.791, 0.815, 1.077, 1.24, 1.25, 1.375, 1.456, 1.5, or any value therebetween. Door stop height portion 4200 can be any length appropriate to fit the existing door frame. For example, in certain exemplary embodiments the door stop height portion 4200 can be, in inches, approximately 0.25, 0.3987, 0.415, 0.5, 0.625, 0.7, 0.812, 0.875, 0.95, 0.975, 1.234, 1.5, or any value therebetween.

Figure 5:
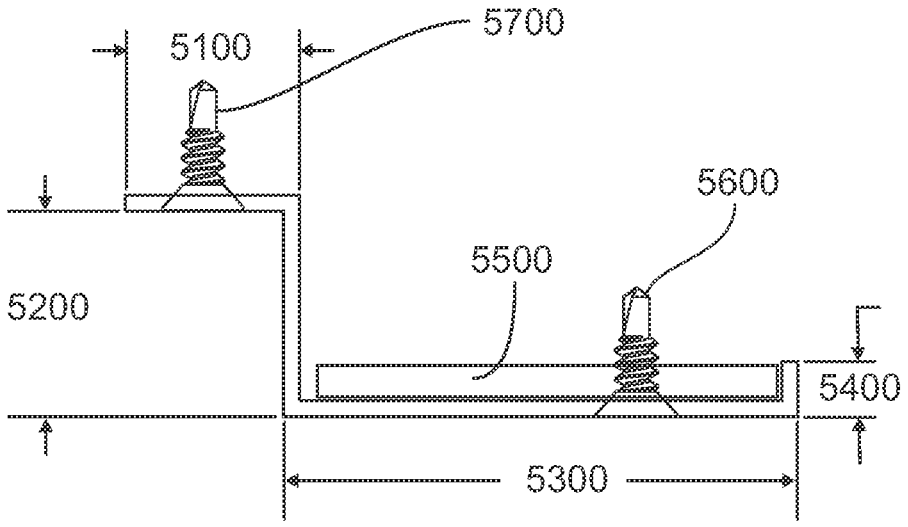
FIG. 5 illustrates a cross-section view of a door stop extension 5000 according to another exemplary embodiment.

FIG. 5 is a cross-section of door stop extension system 5000 according to another exemplary embodiment of the present inventive concept. The door stop extension of system 5000 can be made from steel or stainless steel that is an appropriate thickness, such as sixteen gage cold rolled steel or stainless steel. The door stop extension system 5000 can comprise a spacer 5500, which can be made from a material of a suitable thickness, such as from eleven gage steel in certain exemplary embodiments. Spacer 5500 can be adapted to allow use of the door stop extension system 5000 with a wider range of door frames than would be possible with the door stop extension system 5000 without the spacer 5500. When operatively installed, the spacer 5500 can be substantially in contact with a door stop of a door frame (i.e., door stop 2200 of door frame 2000) to increase a height of a door stop.

The dimensions of cross-section of the door stop extension 5000 comprise a rabbet width portion 5100, a door stop (or soffit) width portion 5300, a soffit flange width portion 5400, and a door stop height portion 5200. Rabbet width portion 5100 does not necessarily need to substantially be the same as a width of the corresponding rabbit on the existing conventional door frame. Rabbet width portion 5100 can be any length appropriate to fit the existing door frame. For example, in certain exemplary embodiments rabbet width portion 5100 can be, in inches, approximately 0.375, 0.419, 0.625, 0.75, 0.8, 0.819, 0.975, 1.133, 1.45, 1.5625, 1.625, 1.75, 1.875, 2.1, 2.357, 2.5, or any value therebetween. Door stop width portion 5300 can be any length appropriate to fit the existing door frame. For example, the door stop width portion 5300 can be, in inches, approximately 0.7, 0.89, 0.913, 0.975, 1.289, 1.54, 1.519, 1.625, 1.75, 1.875, 2.0625, 2.25, 2.357, 2.5, 2.618, 2.819, 3, 3.419, 4.138, 4.793, 5, 5.25, 6. Soffit flange width portion 5400 can be any length appropriate to fit the existing door frame. For example, the soffit flange width portion 5400 can be, in inches, approximately 0.1, 0.119, 0.124, 0.141, 0.167, 0.1775, 0.2, 0.219, 0.25, 0.299, 0.348, 0.5, 0.625, 0.791, 0.815, 1.077, 1.24, 1.25, 1.375, 1.456, 1.5. Door stop height portion 5200 can be any value appropriate to fit the existing door frame. For example, in certain exemplary embodiments door stop height portion 5200 can be, in inches, approximately 0.25, 0.3987, 0.415, 0.5, 0.625, 0.7, 0.812, 0.875, 0.95, 0.975, 1.234, 1.5. System 5000 can be coupled to an existing door frame via fasteners such as a first fastener 5600 and a second fastener 5700.

Figure 6:
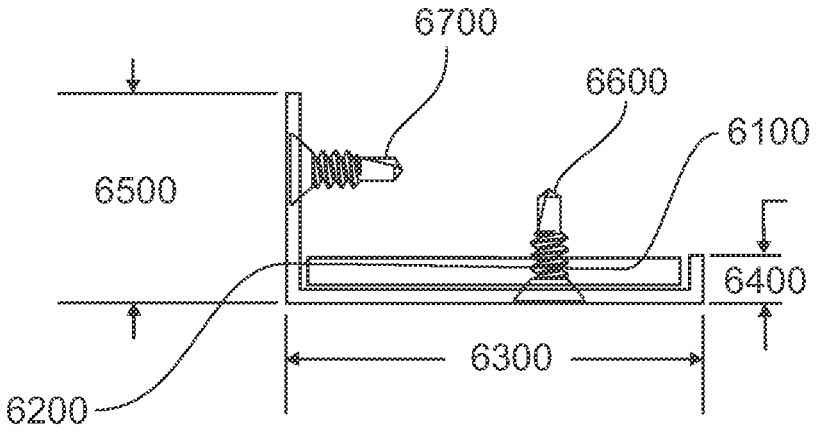
FIG. 6 illustrates a cross-section view of a door stop extension 6000 according to yet another exemplary embodiment.

FIG. 6 illustrates a cross-section of a door stop extension system 6000 according to another exemplary embodiment. System 6000 can comprise a door stop extension 6200 and a spacer 6100. Door stop extension 6200 can be made from steel or stainless steel that is an appropriate thickness, such as sixteen gage cold rolled steel or stainless steel. Spacer 6100 can be made from a material of a suitable thickness, such as from eleven gage steel in certain exemplary embodiments. Spacer 6100 can be adapted to allow use of system 6000 with a wider range of door frames than would be possible with system 6000 not including the spacer 6100. When operatively installed, the spacer 6100 can be substantially in contact with a door stop frame to increase a height of a door stop. The dimensions of a cross-section of system 6000 comprise a width of a door stop (or soffit) width portion 6300, a soffit flange width portion 6400, and a door stop height portion 6500. Door stop width portion 6300 can be any value appropriate to fit the existing door frame. For example, in certain exemplary embodiments door stop width portion 6300 can be, in inches, approximately 0.7, 0.89, 0.913, 0.975, 1.289, 1.54, 1.519, 1.625, 1.75, 1.875, 2.0625, 2.25, 2.357, 2.5, 2.618, 2.819, 3, 3.419, 4.138, 4.793, 5, 5.25, 6. Soffit flange width portion 6400 can be any length appropriate to fit the existing door frame. For example, in certain exemplary embodiments soffit flange width portion 6400 can be, in inches, approximately 0.1, 0.119, 0.124, 0.141, 0.167, 0.1775, 0.2, 0.219, 0.25, 0.299, 0.348, 0.5, 0.625, 0.791, 0.815, 1.077, 1.24, 1.25, 1.375, 1.456, 1.5. Door stop height portion 6500 can be any value appropriate to fit the existing door frame. For example, in certain exemplary embodiments the door stop height portion 6500 can be, in inches, approximately 0.25, 0.3987, 0.415, 0.5, 0.625, 0.7, 0.812, 0.875, 0.9375, 0.95, 0.975, 1.234, 1.5. System 6000 can be coupled to an existing door frame, such as frame 1000, 2000 or 3000, via fasteners such as a first fastener 6600 and a second fastener 6700.

Figure 7:
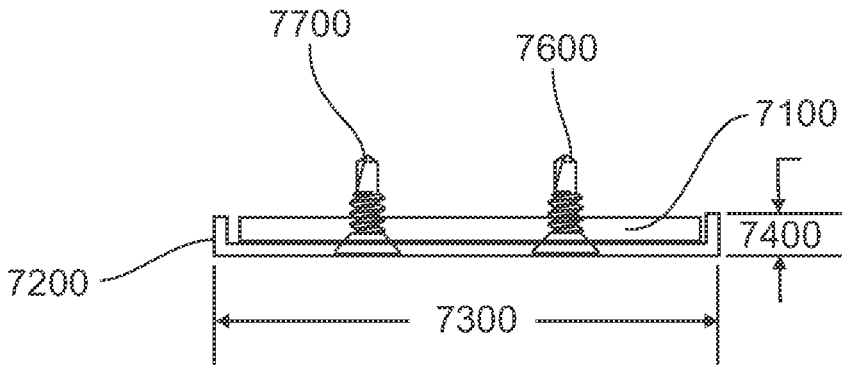
FIG. 7 illustrates a cross-section view of a door stop extension 7000 according to yet another exemplary embodiment.

FIG. 7 is a cross-section of a door stop extension system 7000 according to another exemplary embodiment. System 7000 can comprise a door stop extension 7200 and a spacer 7100. Door stop extension 7200 can be made from steel or stainless steel that is an appropriate thickness, such as sixteen gage cold rolled steel or stainless steel. Spacer 7100 can be made from a material of a suitable thickness, such as from eleven gage steel in certain exemplary embodiments. Spacer 7100 can be adapted to allow use of system 7000 with a wider range of door frames than would be possible with system 7000 without spacer 7100. When operatively installed, spacer 7100 can be substantially in contact with an existing door stop frame to increase a height of a door stop of the door frame. The dimensions of the cross-section of the system 7000 comprise a width of a door stop (or soffit) width portion 7300 and a soffit flange width portion 7400. A width of the door stop width portion 7300 can be any value appropriate to fit an existing door frame. For example, in certain exemplary embodiments the door stop width portion 7300 can be, in inches, approximately 0.7, 0.89, 0.913, 0.975, 1.289, 1.54, 1.519, 1.625, 1.75, 1.875, 2.0625, 2.25, 2.357, 2.5, 2.618, 2.819, 3, 3.419, 4.138, 4.793, 5, 5.25, 6. Soffit flange width portion 7400 can be any value appropriate to fit the existing door frame. For example, in certain exemplary embodiments the soffit flange width portion 7400 can be, in inches, approximately 0.1, 0.119, 0.124, 0.141, 0.167, 0.1775, 0.2, 0.219, 0.25, 0.299, 0.348, 0.5, 0.625, 0.791, 0.815, 1.077, 1.24, 1.25, 1.375, 1.456, 1.5. System 7000 can be coupled to an existing door frame via fasteners such as first a fastener 7600 and a second fastener 7700.

Figure 8:
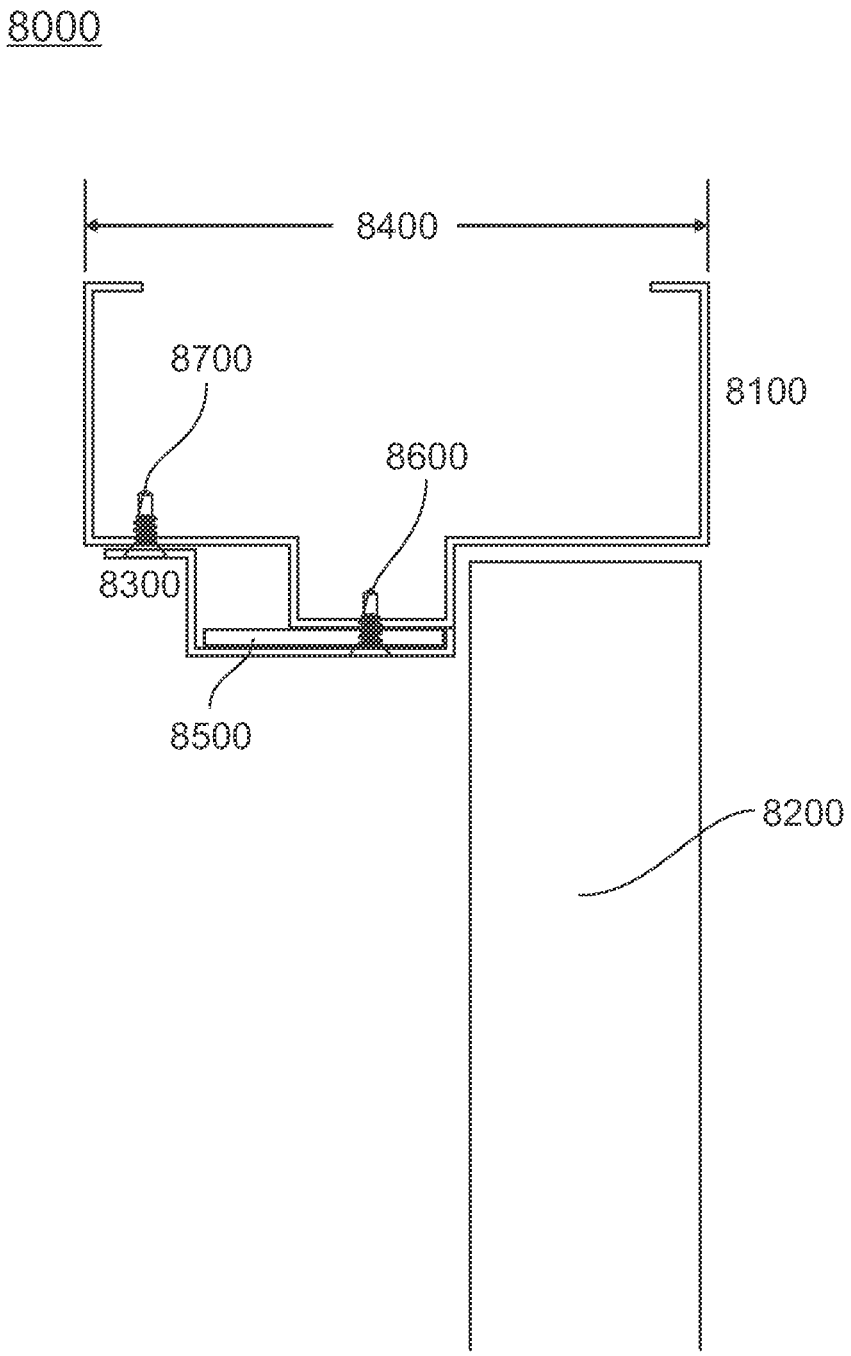
FIG. 8 illustrates a cross-section view of a door stop extension 8000 according to still another exemplary embodiment.

FIG. 8 is a cross-section of a door stop extension system 8000 according to another exemplary embodiment, which can comprise a door stop extension portion 8300 and a spacer 8500. A pre-existing door frame 8100 can be a hollow metal frame. Also illustrated for a better understanding is a pre-existing a door 8200. Jamb depths of the hollow metal frame can range from approximately three inches to approximately fourteen inches in one eighth of inch increments. Door stop extension 8300 can be sized to fit actual door frames. Door stop extension 8300 and spacer 8500 can be operatively coupled to the pre-existing door frame 8100 via fasteners such as a first fastener 8600 and a second fastener 8700. Door frame 8100 can have an overall width 8400, which can be any door frame width. For example, in certain exemplary embodiments overall width 8400 can be, in inches, approximately 1, 1.289, 1.54, 1.519, 1.625, 1.75, 1.875, 2.0625, 2.25, 2.357, 2.5, 2.618, 2.819, 3, 3.419, 4.138, 4.75 4.793, 5, 5.25, 6.

Figure 9:
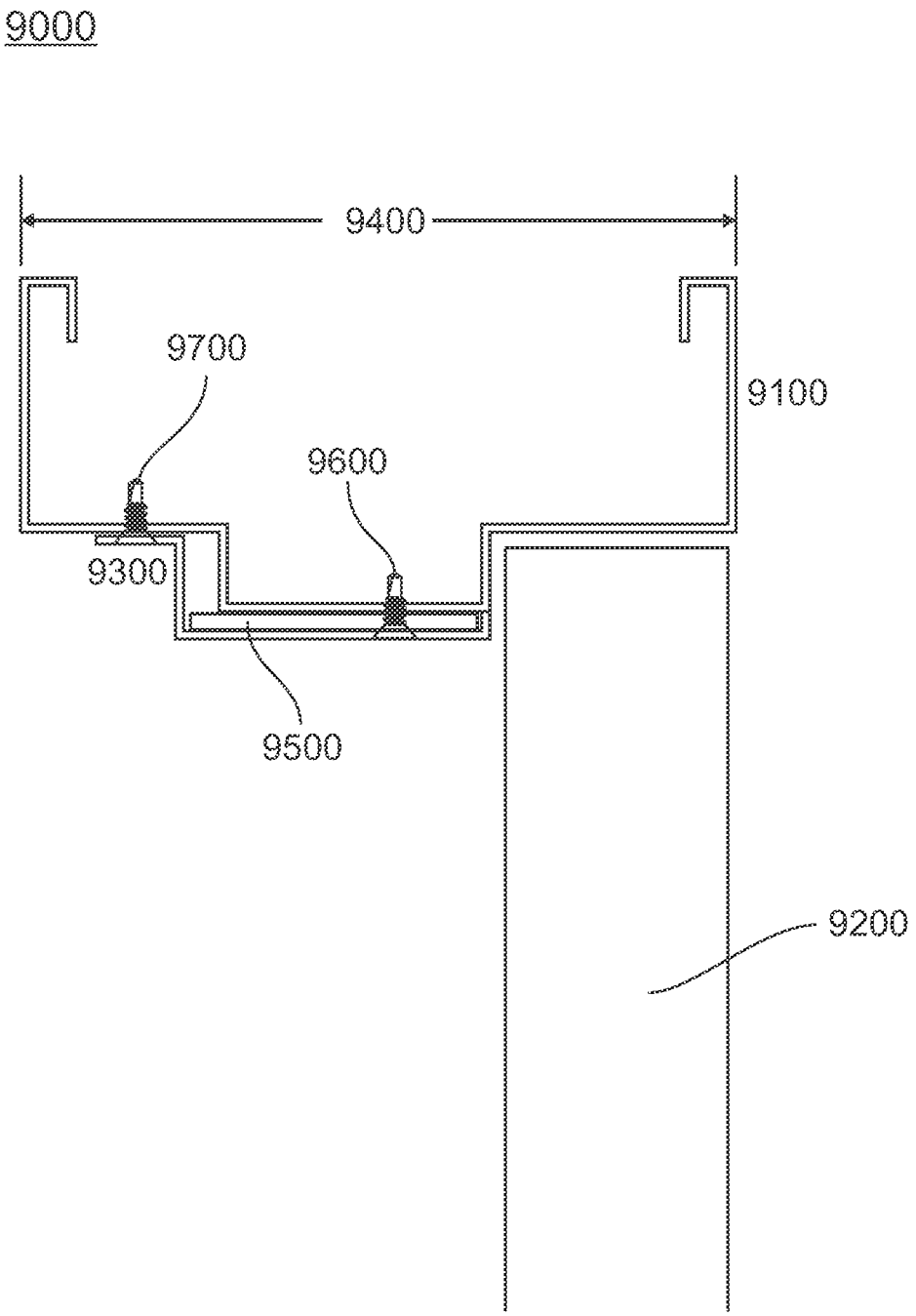
FIG. 9 is a cross-section of a door stop extension 9000 according to still another exemplary embodiment.

FIG. 9 is a cross-section of a door stop extension system 9000 according to another exemplary embodiment of a system 9000, which can comprise a door stop extension 9300 and a spacer 9500. A pre-existing door frame 9100 can be a hollow metal frame. Also illustrated is a door 8200 for a better understanding of the operations of the door stop extension system 9000. Jamb depths of the hollow metal frame can range from approximately three inches to approximately fourteen inches in one eighth of inch increments. Door stop extension 9300 can be sized to fit actual door frames. Door stop extension 9300 and spacer 9500 can be operatively coupled to the pre-existing door frame 9100 via fasteners such as a first fastener 9600 and a second fastener 9700. Door frame 9100 can have an overall width 9400, which can be any door frame width. For example, in certain exemplary embodiments overall width 9400 can be, in inches, approximately 1, 1.289, 1.54, 1.519, 1.625, 1.75, 1.875, 2.0625, 2.25, 2.357, 2.5, 2.618, 2.819, 3, 3.419, 4.138, 4.75 4.793, 5, 5.25, 5.625, 5.919, 6.334, 6.875, 7.257, 7.64, 8.

Figure 10:
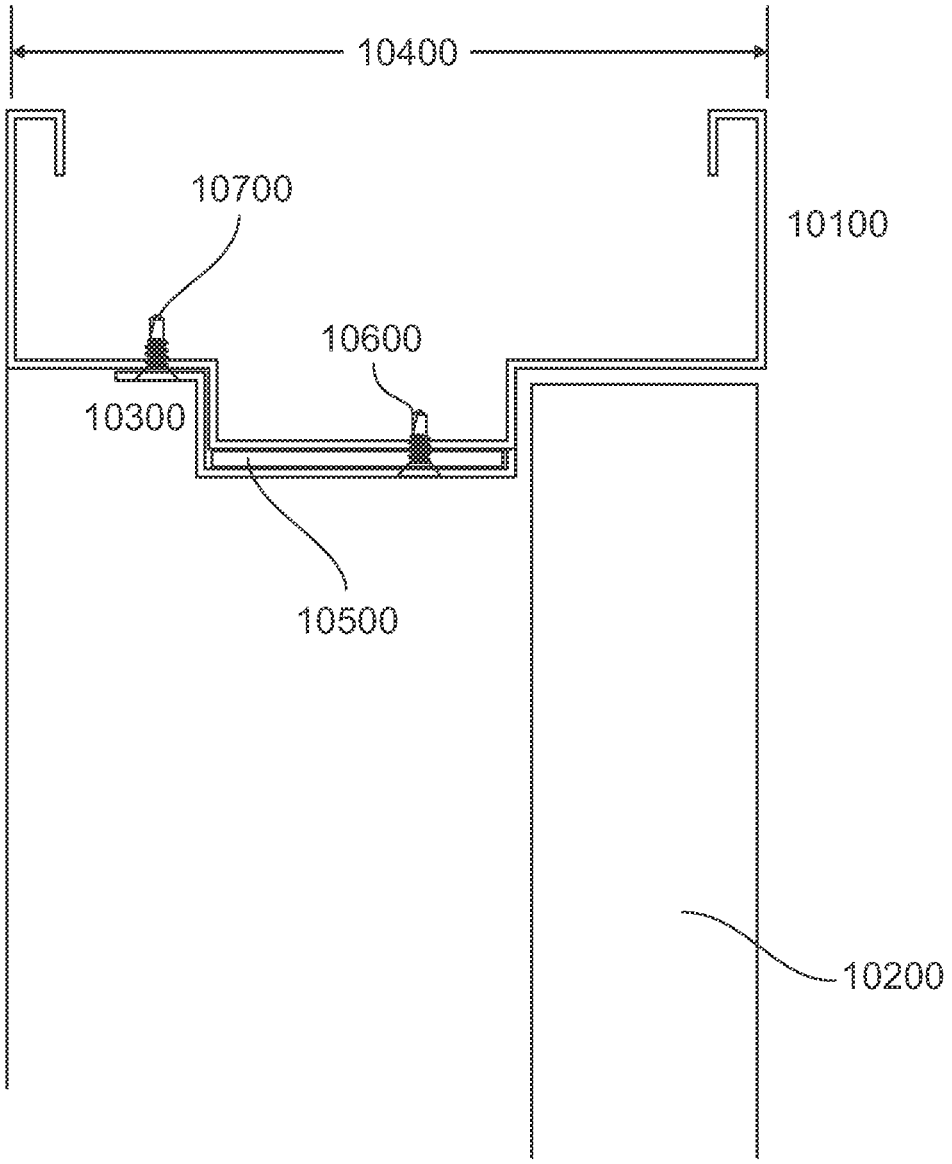
FIG. 10 is a cross-section of a door stop extension 10000 according to still another exemplary embodiment.

FIG. 10 is a cross-section of a door stop extension system 10000 according to another exemplary embodiment, which can comprise a door stop extension 10300 and a spacer 10500. A door frame 10100 can be a hollow metal frame. Also illustrated is a door 10200 for a better understanding of the operations of the door stop extension system 10000. Jamb depths of the hollow metal frame can range from approximately three inches to approximately fourteen inches in one eighth of inch increments. Door stop extension 10300 can be sized to fit actual door frames. Door stop extension 10300 and spacer 10500 can be operatively coupled to the pre-existing door frame 10100 via fasteners such as a first fastener 10600 and a second fastener 10700. The pre-existing door frame 10100 can have an overall width 10400, which can be any door frame width. For example, in certain exemplary embodiments overall width 10400 can be, in inches, approximately 1, 1.289, 1.54, 1.519, 1.625, 1.75, 1.875, 2.0625, 2.25, 2.357, 2.5, 2.618, 2.819, 3, 3.419, 4.138, 4.75 4.793, 5, 5.25, 5.625, 5.875, 5.919, 6.334, 6.875, 7.257, 7.64, 8.

Figure 11:
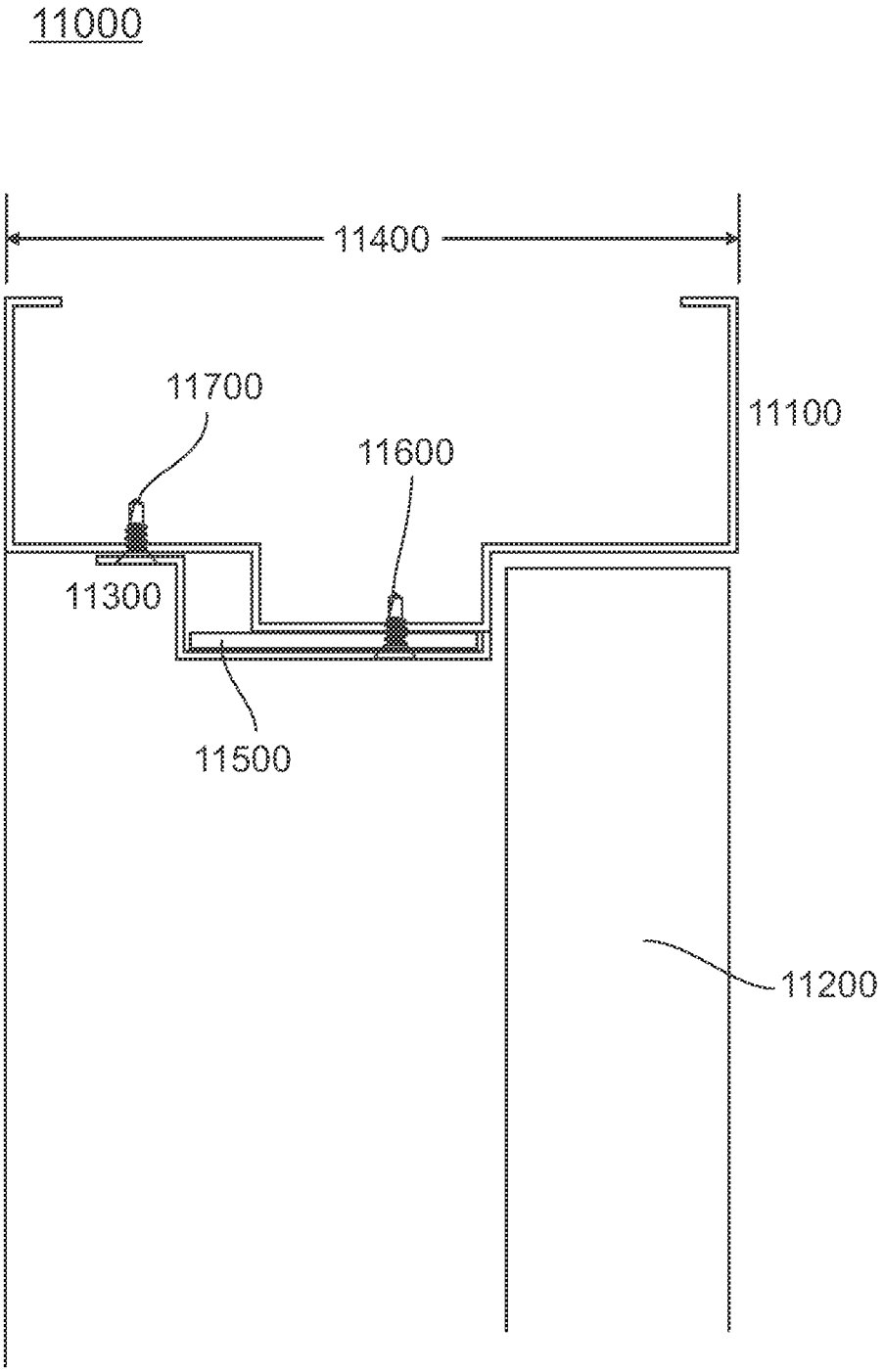
FIG. 11 is a cross-section of a door stop extension 11000 according to still another exemplary embodiment.

FIG. 11 is a cross-section of a door stop extension system 11000 according to another exemplary embodiment, which can comprise a door stop extension 11300 and a spacer 11500. A pre-existing door frame 11100 can be a hollow metal frame. Also illustrated is a door 11200 for a better understanding of the operations of the door stop extension system 10000. Jamb depths of the hollow metal frame can range from approximately three inches to approximately fourteen inches in one eighth of inch increments. Door stop extension 11300 can be sized to fit actual door frames. Door stop extension 11300 and spacer 11500 can be operatively coupled to the pre-existing door frame 11100 via fasteners such as a first fastener 11600 and a second fastener 11700. Door frame 11100 can have an overall width 11400, which can be any door frame width. For example, in certain exemplary embodiments overall width 11400 can be, in inches, approximately 1, 1.289, 1.54, 1.519, 1.625, 1.75, 1.875, 2.0625, 2.25, 2.357, 2.5, 2.618, 2.819, 3, 3.419, 4.138, 4.75 4.793, 5, 5.25, 5.625, 5.75, 5.875, 5.919, 6.334, 6.875, 7.257, 7.64, 8.

Figure 12:
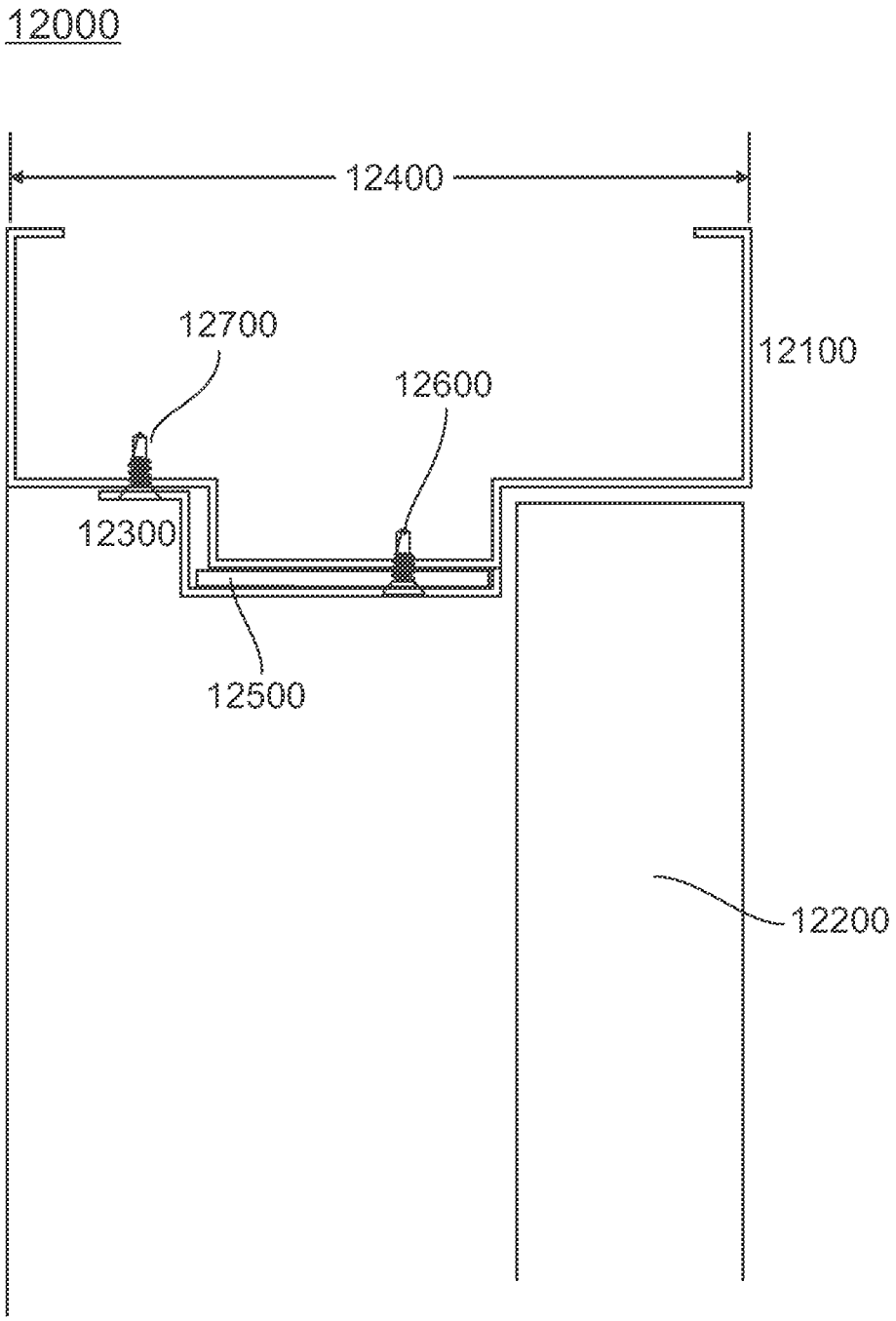
FIG. 12 is a cross-section of a door stop extension 12000 according to still another exemplary embodiment.

FIG. 12 is a cross-section of a door stop extension system 12000 according to another exemplary embodiment, which can comprise a door stop extension 12300 and a spacer 12500. A pre-existing door frame 12100 can be a hollow metal frame. Jamb depths of the hollow metal frame can range from approximately three inches to approximately fourteen inches in one eighth of inch increments. Door stop extension 12300 can be sized to fit actual door frames. Door stop extension 12300 and spacer 12500 can be operatively coupled to the pre-existing door frame 12100 via fasteners such as a first fastener 12600 and a second fastener 12700. Door frame 12100 can have an overall width 12400, which can be any door frame width. For example, in certain exemplary embodiments overall width 12400 can be, in inches, approximately 1, 1.289, 1.54, 1.519, 1.625, 1.75, 1.875, 2.0625, 2.25, 2.357, 2.5, 2.618, 2.819, 3, 3.419, 4.138, 4.75 4.793, 5, 5.25, 5.625, 5.75, 5.875, 5.919, 6.334, 6.875, 7.257, 7.64, 8.

Figure 13:
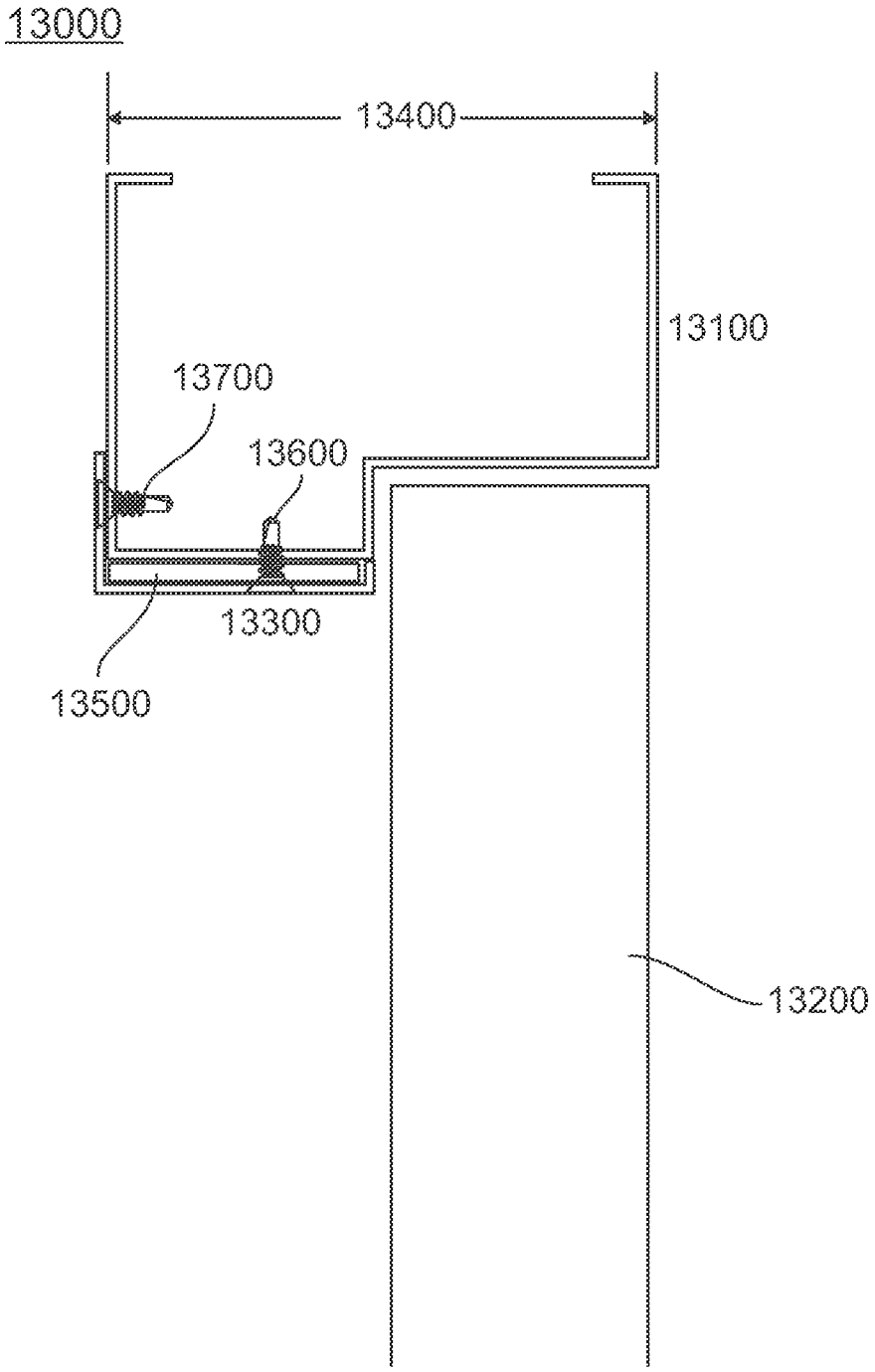
FIG. 13 is a cross-section of a door stop extension 13000 according to still another exemplary embodiment.

FIG. 13 is a cross-section of a door stop extension system 13000 according to another exemplary embodiment, which can comprise a door stop extension 13300 and a spacer 13500. The pre-existing door frame 13100 can be a hollow metal frame. Jamb depths of the hollow metal frame can range from approximately three inches to approximately fourteen inches in one eighth of inch increments. Door stop extension 13300 can be sized to fit actual door frames. Door stop extension 13300 and spacer 13500 can be operatively coupled to the pre-existing door frame 13100 via fasteners such as a first fastener 13600 and a second fastener 13700. Door frame 13100 can have an overall width 13400, which can be any door frame width. For example, in certain exemplary embodiments the overall width 13400 can be, in inches, approximately 1, 1.289, 1.54, 1.519, 1.625, 1.75, 1.875, 2.0625, 2.25, 2.357, 2.5, 2.618, 2.819, 3, 3.419, 3.75, 4.138, 4.75 4.793, 5, 5.25, 5.625, 5.75, 5.875, 5.919, 6.334, 6.875, 7.257, 7.64, 8.

Figure 14:
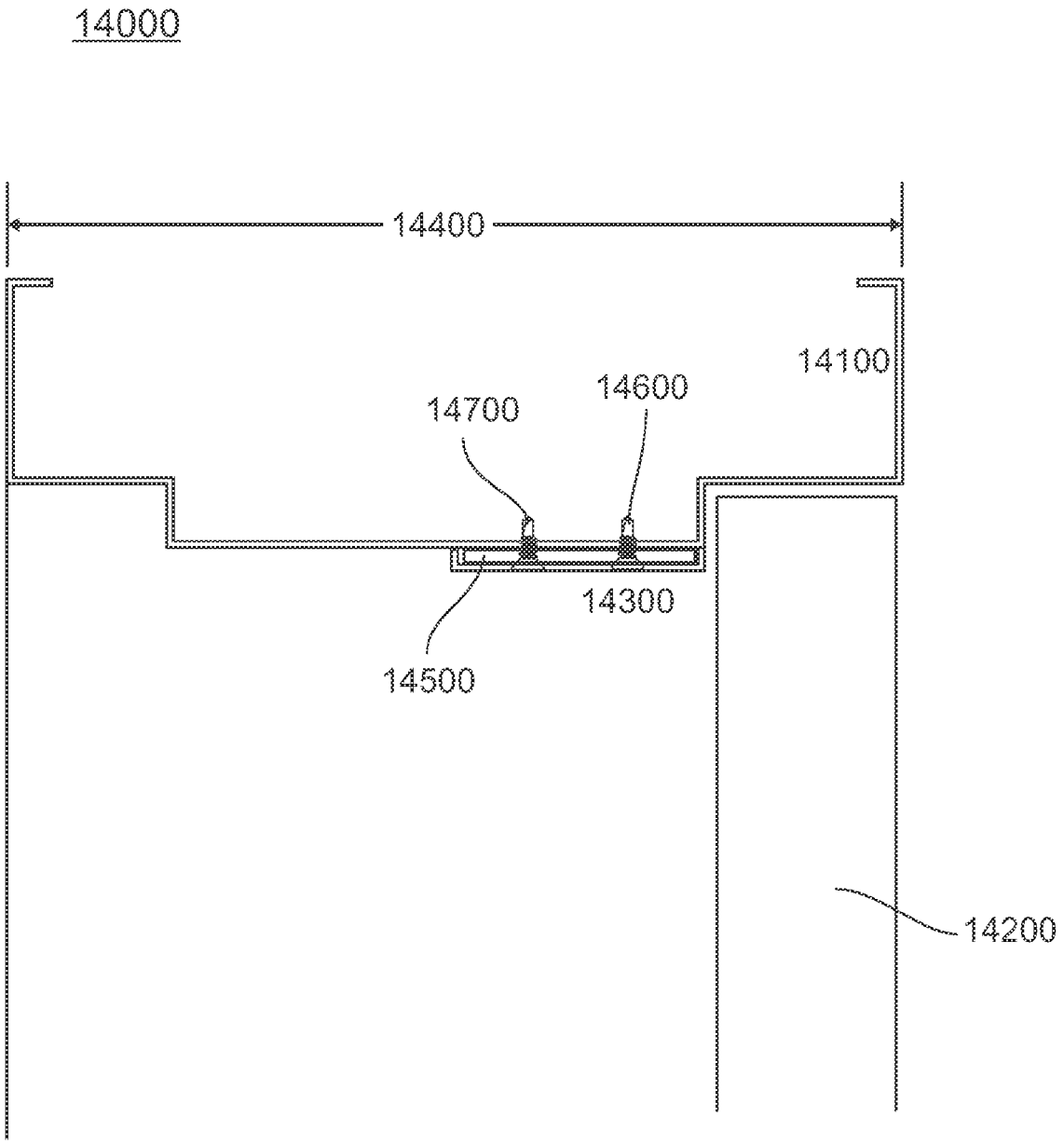
FIG. 14 is a cross-section of a door stop extension 14000 according to still another exemplary embodiment.

FIG. 14 is a cross-section of a door stop extension system 14000 according to another exemplary embodiment, which can comprise a door stop extension 14300 and a spacer 14500. Door frame 14100 can be a hollow metal frame. Jamb depths of the hollow metal frame can range from approximately three inches to approximately fourteen inches in one eighth of inch increments. Door stop extension 14300 can be sized to fit actual door frames. Door stop extension 14300 and spacer 14500 can be operatively coupled to the pre-existing door frame 14100 via fasteners such as a first fastener 14600 and a second fastener 14700. Door frame 14100 can have an overall width 14400, which can be any door frame width. For example, in certain exemplary embodiments overall width 14400 can be, in inches, approximately 1, 1.289, 1.54, 1.519, 1.625, 1.75, 1.875, 2.0625, 2.25, 2.357, 2.5, 2.618, 2.819, 3, 3.419, 3.75, 4.138, 4.75 4.793, 5, 5.25, 5.625, 5.75, 5.875, 5.919, 6.334, 6.875, 7.257, 7.64, 8, 8.109, 9.34, 8.75, 9, 9.317, 9.88, 10.34, 10.625. 11.3, 11.494, 11.818, 12.

Figure 15:
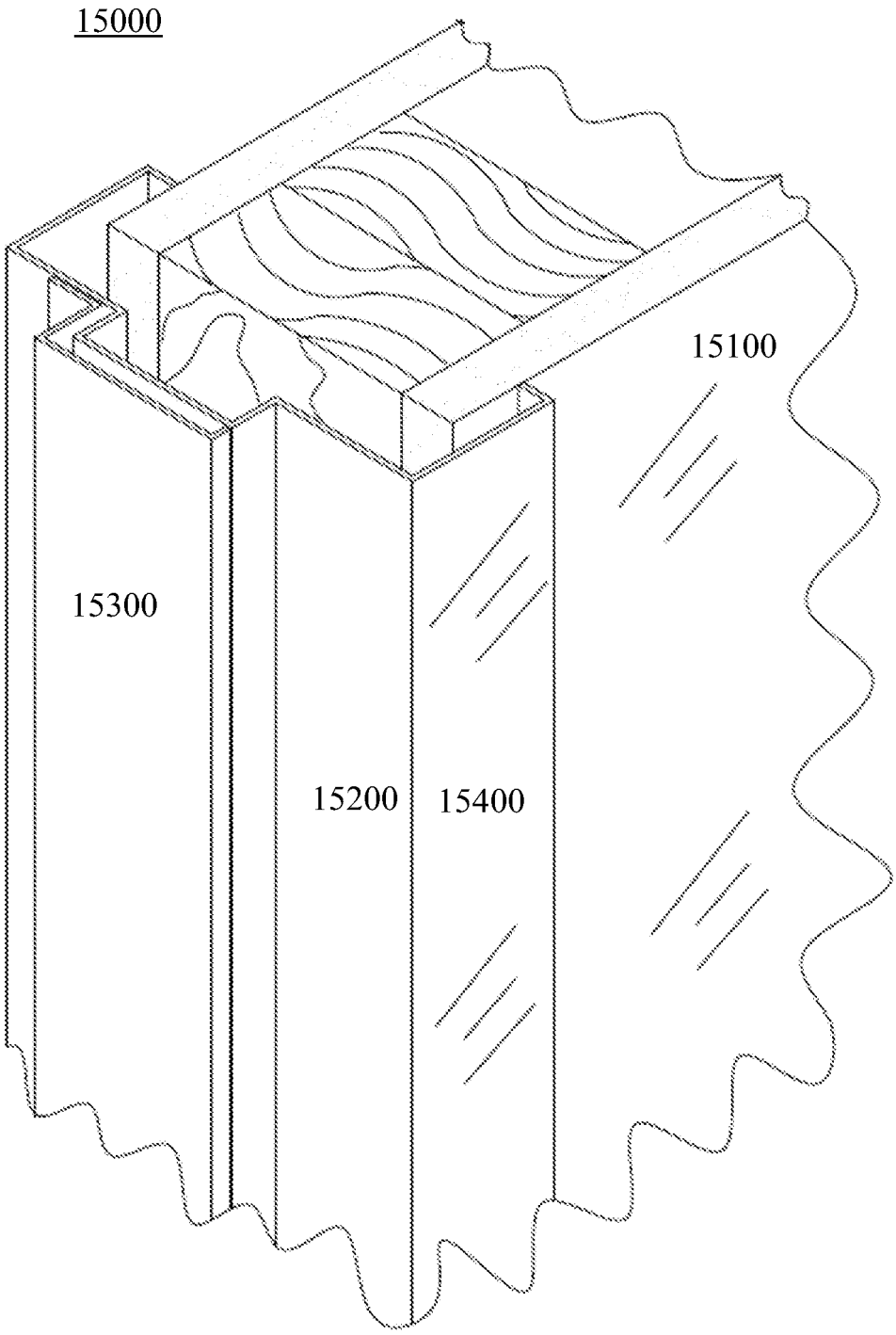
FIG. 15 is a perspective view of a door stop extension 15000 according to still another exemplary embodiment.

FIG. 15 is a perspective view of a door stop extension system 15000 according to another exemplary embodiment, which can comprise a door stop extension 15300. System 15000 illustrates door stop extension 15300 installed to increase a door stop height of the pre-existing door frame 15400. Also illustrated are a pre-existing walls 15100 and conventional strike plate 15200.

Figure 16:
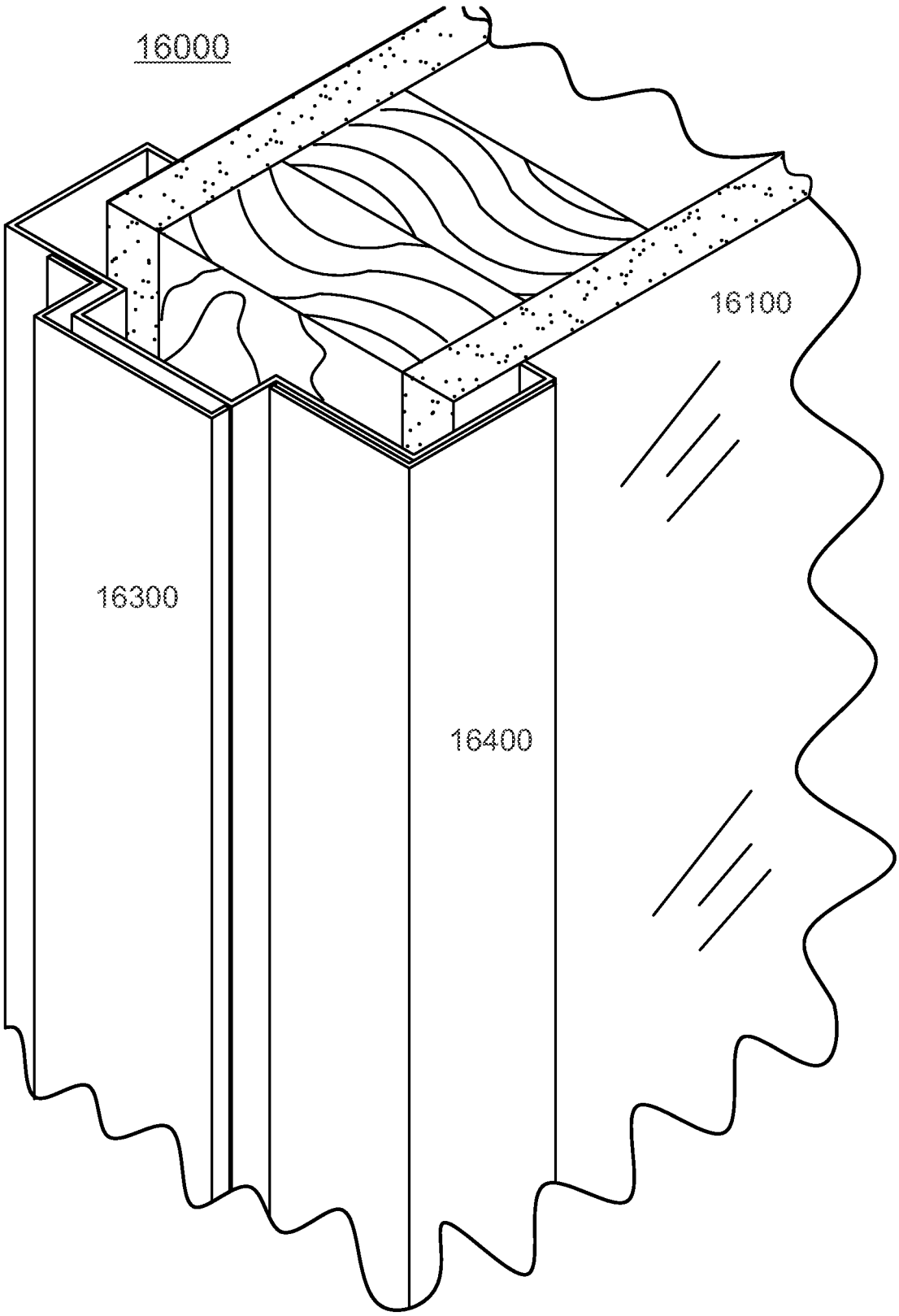
FIG. 16 is a perspective view of a door stop extension 16000 according to still another exemplary embodiment.

FIG. 16 is a perspective view of a door stop extension system 16000 according to another exemplary embodiment, which can comprise a door stop extension 16300. System 16000 illustrates the door stop extension 16300 installed to increase a door stop height of a pre-existing door frame 16400.

Figure 17:
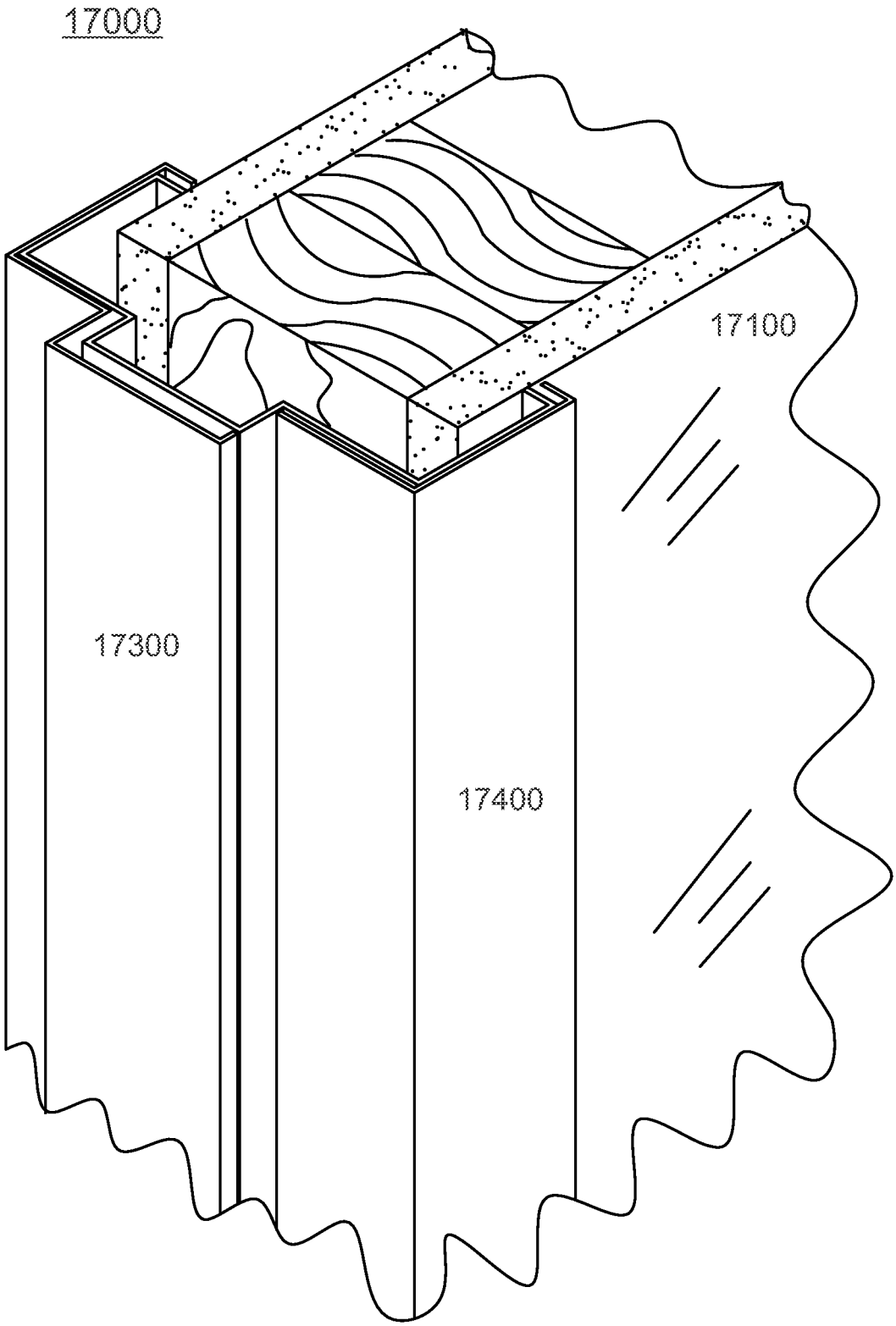
FIG. 17 is a perspective view of a door stop extension 17000 according to still another exemplary embodiment.

FIG. 17 is a perspective view of a door stop extension system 17000 according to another exemplary embodiment, which can comprise a door stop extension 17300. System 17000 illustrates door stop extension 17300 installed to increase a door stop height of a pre-existing door frame 17400.

Figure 18:
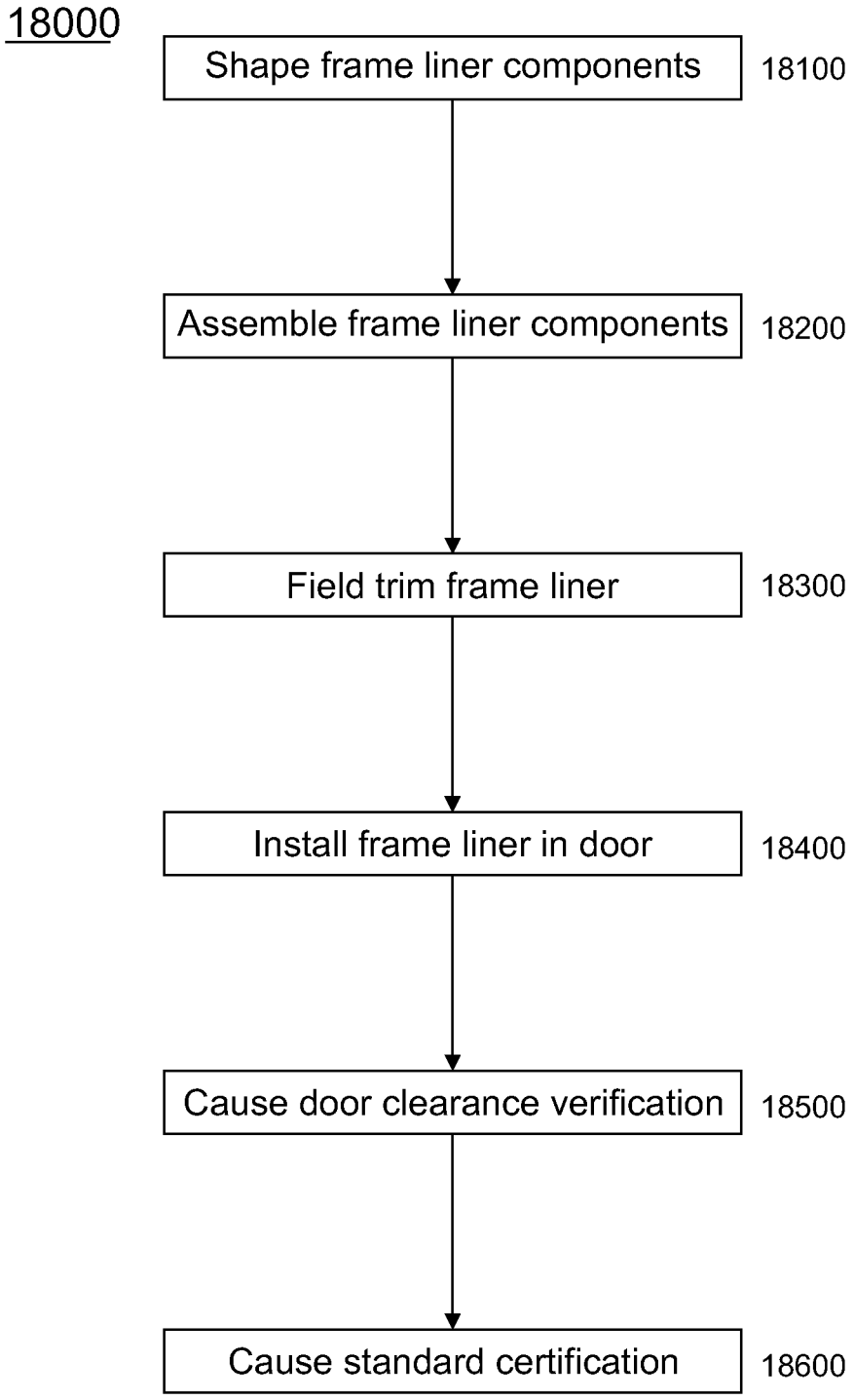
FIG. 18 is a flowchart of an exemplary embodiment of a method 18000.

FIG. 18 is a flowchart of an exemplary embodiment of a method 18000. At activity 18100, door stop extension components can be shaped. For example, sheet metal strips can be placed in a metal break to form a shape that substantially conforms to an existing door frame. At activity 18200, the door stop extension components can be assembled. After shaping, the metal strips can be welded together in a manner to result in a door stop extension adapted to extend a door stop height of the existing door frame.

At activity 18300, the door stop extension can be field trimmed. For example, legs of the door stop extension can be fabricated for a maximum height door of a given width. Legs of the door stop extension can be trimmed to an actual height of the existing door frame. At activity 18400, the door stop extension can be installed. At activity 18500, a door clearance verification can be caused. At activity 18600, a standard certification can be caused. An inspector can examine the door system and verify that the door meets or exceeds a predetermined standard, such as National Fire Protection Association's publication 80 specifications. In certain exemplary embodiments, a correction of a non-compliance with National Fire Protection Association's publication 80 specifications can be caused via installation of a door stop extension in a door frame. The door stop extension can be adapted to increase a door stop height by a predetermined amount.

DEFINITIONS

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.

achieve—meet requirements for.

across—from one side to another.

activity—an action, act, step, and/or process or portion thereof adapted to—made suitable or fit for a specific use or situation.

adapter—a device used to effect operative compatibility between different parts of one or more pieces of an apparatus or system.

amount—a measurable distance.

and/or—either in conjunction with or in alternative to.

apparatus—an appliance or device for a particular purpose.

approximate—near or approaching.
associate—to join, connect together, and/or relate.
back—a portion of a door stop extension adapted to be nearest to a door frame when the door stop extension is installed.
bending/breaking angles—causing a metal object to have a shape that comprises a corner such as via a metalworking machine.
beyond—further on than.
can—is capable of in at least some embodiments.
cause—to produce an effect.
clearance—a spacing distance between two objects.
cold rolled steel—steel that is reduced in thickness via passage between one or more pairs of rolls while the steel is at a temperature that is below its recrystallization temperature.
comprising—including but not limited to.
configure—to make suitable or fit for a specific use or situation.
connect—to join or fasten together.
contact—to directly touch.
continuous reinforcement plate—a substantially flat piece of metal of substantially uniform thickness that extends substantially a full length of a reinforced component.
convert—to transform, adapt, and/or change.
correct—to remove a fault.
countersunk—to enlarge a part of a cavity, such a via chamfering, such that the enlarged part is adapted to receive and substantially surround a cone-shaped head of a fastener.
couple—to join, connect, and/or link together.
create—to bring into being.
define—to establish the outline, form, or structure of
device—a machine, manufacture, and/or collection thereof
diameter—a straight line distance from side to side of a body, and through the body's center.
dimensional tolerance—a maximum permitted variation in a measurement of an object.
direct contact—touching.
door—a movable and solid barrier adapted for opening and closing an entranceway.
door frame—a structure that partially surrounds a doorway, including two jambs and a lintel, or head.
door stop—a portion of a door frame adapted to restrain a door from motion beyond a latching point when the door is being closed.
door stop extension—a shaped object adapted to be installed in a door frame and adapted to increase a height of a door stop.
door stop height—a distance from a door frame rabbet to a most extended portion of a door stop.
drill—to bore a hole in.
established standard—a predetermined dimension.
extend—to protrude.
face—a portion of a door stop extension adapted to be nearest to a door opening when the door stop extension is installed.
fastener—one (or more) restraint that attaches to, extends through, penetrates, and/or holds something. For example, a fastener can be one (or more) bolt and nut assembly, rivet, weldment, nail, screw, peg, staple, clip, buckle, clasp, clamp, hook and loop assembly, adhesive, and/or plastic push rivet, etc.
field cut—changed in size at or near a point of installation.
fire rating—a measure of the extent to which a system can withstand a predetermined set of fire resistance test conditions.
fire resistant—substantially unburnable under a given set of conditions.
fit—to be of the right size or shape for.
full length—substantially an entire extent of a longest dimension of an object.
height—a distance from a base to an apex.
increase—to make greater in size.
industry standard—an established norm or requirement in regard to door systems.
install—to connect or set in position and prepare for use.
latch—to close or fasten via a bolt sliding into a cutout in a door frame.
lock—to secure a door from opening via a system comprising at least one bolt propelled and withdrawn by a mechanism operable by a key.
may—is allowed and/or permitted to, in at least some embodiments.
method—a process, procedure, and/or collection of related activities for accomplishing something.
narrow door profile frame—a door frame having a width of less than approximately two inches.
National Fire Protection Association—a United States trade association that creates and maintains private, copyrighted, standards and codes for usage and adoption by local governments and having a business address of 1 Batterymarch Park, Quincy, Mass. 02169-7471
National Fire Protection Association's publication 80 specifications—a Standard for Fire Doors and Other Opening Protectives established by the National Fire Protection Association.
non-compliance—a failure to meet a standard.
opening—an aperture.
oppose—to be on an opposite side of
outer shell—a portion of a door stop extension that is exposed when the door stop extension is installed.
plane—a substantially flat surface.
plurality—the state of being plural and/or more than one.
predetermined—established in advance.
project—to protrude.
protrude—to extend out from.
provide—to furnish, supply, give, and/or make available.
rabbet—a recess or step, usually of rectangular section, cut into a surface or along the edge of a door frame.
receive—to get as a signal, take, acquire, and/or obtain.
reduce—to diminish to some extent.
screw—a metal fastener having a tapered shank with a helical thread, and topped with a slotted head, driven into a substance by rotating, such as by with a screwdriver.
screw holes—apertures in a strike plate that are adapted to receive threaded fasteners and thereby fasten the strike plate to a mortised pocket of a door frame.
select—to choose from a plurality of available options.
set—a related plurality.
shape—an outward form of an object defined by outline.
sixteen gage—metal having a thickness of approximately 0.0598 inches.
spacer—a piece of material used to create or maintain a space between two things.
stainless steel—alloy steel containing approximately twelve percent or more chromium.
steel—any of various alloys based on iron containing carbon (usually approximately 0.1 percent to approximately 1.7 percent).
steel reinforcement plate—a substantially flat piece of metal of substantially uniform thickness that is adapted to provide improved structural properties to a system when installed in the system.

substantially—to a great extent or degree.

sufficient—adequate to accomplish a purpose.

support—to bear the weight of, especially from below.

surface area—a dimensional extent of one or more faces of an object that are touchable by another object.

swinging door—a hinged, barrier at the entrance to a building or room that is coupled to a door hardware bolt.

system—a collection of mechanisms, devices, machines, articles of manufacture, processes, data, and/or instructions, the collection designed to perform one or more specific functions.

tack weld—to join (pieces of metal) with a number of small welds spaced some distance apart.

thickness—measure of a distance from a back face of a strike plate to a front face of the strike plate, the back face of the strike plate adapted to directly contact a mortised pocket on a door when the strike plate is installed in a door frame.

via—by way of and/or utilizing.

weight—a value indicative of importance.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

no characteristic, function, activity, or element is "essential";

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and nonlimiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. In a door frame system comprising a rabbet portion, a door rabbet portion and a door stop protruding outward from and between the rabbet portion and the door rabbet portion to stop a door within the door rabbet portion, the improvement comprising:

a door stop extension configured to be attached to the door frame system, the door stop extension consisting essentially of:

a first portion to extend across the rabbet portion of the door frame;

a second portion extending at a right angle from the first portion away from the rabbet portion and across a surface of a first side of a door stop;

a third portion to extend at a right angle from the second portion and away from the first portion to extend from a first side of the door stop and across a face surface thereof, the third portion terminating at a second side of the door stop to be flush with the second side of the door stop; and a fourth portion extending at a right angle from the third portion toward the door stop and along a same line as the second side of the door stop, the fourth portion terminating at the door stop such that the fourth portion becomes an extension of the second side of the door stop.

2. The door stop extension of claim 1, further consisting of:

a spacer adapted to be installed between the second portion of the door stop extension and the face surface of the door stop when said door stop extension is installed on narrow door profile door frames.

3. The door stop extension of claim 1, further consisting of:

a fastener extending through the third portion thereof and coupled to the face surface of the door stop.

4. The door stop extension of claim 1, further consisting of:

a fastener extending through the first portion thereof and coupled to the rabbet section of the door frame.

5. The door stop extension of claim 1, wherein an outer shell of the door stop extension is formed from steel or stainless steel.

6. In a door frame system comprising a rabbet portion, a door rabbet portion and a door stop having a first side protruding outward from the rabbet portion, a second side protruding outward from the door rabbet portion and a face extending between the first and second side and in parallel with the rabbet portion and door rabbet portion, the improvement comprising:

a door stop extension to be attached to the door frame system, the door stop extension consisting essentially of:

a first portion to extend across the rabbet portion of the door frame;

a second portion extending at a right angle from the first portion away from the rabbet portion and in parallel with the first side of a door stop and to terminate at a predetermined distance beyond the face of the door stop;

a third portion extending at a right angle from the second portion and away from the first portion in parallel with and spaced apart from the face the door stop; and a fourth portion extending at a right angle from the third portion toward the door stop and along a same line as the second side of the door stop, the fourth portion terminating at the door stop such that the fourth portion becomes an extension of the second side of the door stop.

7. The door stop extension of claim 6, further consisting of:

a spacer disposed between the third portion and the face of the door stop.

8. In a door frame system comprising a rabbet portion, a door rabbet portion and a door stop having a first side protruding outward from the rabbet portion, a second side protruding outward from the door rabbet portion and a face extending between the first and second side and in parallel with the rabbet portion and door rabbet portion, the improvement comprising:

a door stop extension to be attached to the door frame system, the door stop extension consisting essentially of:

a first portion to extend along a length of the first side of the door stop;

a second portion extending at a right angle from the first portion and along a length of the face of the door stop; and a third portion extending at a right angle from the second portion toward the face of the door stop, the third portion making contact with an edge of the face of the door stop such that the third portion is coplanar with the second side of the door stop.

9. The door stop extension of claim 8, further consisting of:

at least two first fasteners extending through the first portion and into the first side of the door stop to couple the first portion thereto; and at least two second fasteners extending through the second portion and into the face of the door stop to couple the second portion thereto.

10. The door stop extension of claim 9, further consisting of:

a spacer disposed along a length between the second portion and the face of the door stop to maintain a predetermined distance between the second portion and the face of the door stop, each of the at least two second fasteners extending through the spacer.

11. In a door frame system comprising a rabbet portion, a first outer shell portion extending from the rabbet portion around one side of a wall, a door rabbet portion, a second outer shell portion extending from the door rabbet portion around a second side of the wall and a door stop protruding outward from and between the rabbet portion and the door rabbet portion to stop a door within the door rabbet portion, the improvement comprising:

a door stop extension configured to be attached to the door frame system, the door stop extension consisting essentially of:

a first portion to extend across the rabbet portion of the door frame;

a second portion extending at a right angle from the first portion away from the rabbet portion and across a surface of a first side of a door stop;

a third portion to extend at a right angle from the second portion and away from the first portion to extend from a first side of the door stop and across a face surface thereof, the third portion terminating at a second side of the door stop to be flush with the second side of the door stop;

a fourth portion extending at a right angle from the third portion toward the door stop and along a same line as the second side of the door stop, the fourth portion terminating at the door stop such that the fourth portion becomes an extension of the second side of the door stop; and a fifth portion extending at a right angle from the first portion and configured to cover an entire surface of the first outer shell portion extending from the rabbet portion around one side of the wall.

* * * * *